US007407142B1

(12) United States Patent
Lopez

(10) Patent No.: US 7,407,142 B1
(45) Date of Patent: Aug. 5, 2008

(54) HAIR COLLECTION DEVICE

(76) Inventor: William Lopez, 8292 Acapulco Pl., Riverside, CA (US) 92504

( * ) Notice: Subject to any disclaimer, the term of this patent is extended or adjusted under 35 U.S.C. 154(b) by 236 days.

(21) Appl. No.: 10/455,948

(22) Filed: Jun. 6, 2003

(51) Int. Cl.
*F16M 45/08* (2006.01)

(52) U.S. Cl. ..... 248/304; 248/205.2; 248/305; 4/559; 4/605

(58) Field of Classification Search ..... 248/304, 248/309.3, 309.4, 205.2, 467, 466, 339, 301, 248/302, 311.2, 305; 4/559, 568, 605
See application file for complete search history.

(56) References Cited

U.S. PATENT DOCUMENTS

| | | | | | |
|---|---|---|---|---|---|
| D205,452 | S | | 8/1966 | Wahl | |
| 4,327,837 | A | * | 5/1982 | Ross | 211/85.3 |
| 4,721,276 | A | * | 1/1988 | Moss | 248/311.2 |
| 4,951,910 | A | * | 8/1990 | March | 248/311.2 |
| 5,175,896 | A | * | 1/1993 | Zamir | 4/606 |
| 5,228,165 | A | * | 7/1993 | Westberry et al. | 15/160 |
| 5,269,073 | A | | 12/1993 | Johnson | |
| 5,277,389 | A | * | 1/1994 | Ballares et al. | 248/206.3 |
| D353,492 | S | * | 12/1994 | Goodman et al. | D6/323 |
| D377,599 | S | * | 1/1997 | Hofman | D8/372 |
| 5,678,793 | A | * | 10/1997 | Hill | 248/206.3 |
| 5,944,029 | A | * | 8/1999 | Brenner | 132/247 |
| 5,950,236 | A | * | 9/1999 | Andrew et al. | 2/50 |
| D417,341 | S | * | 12/1999 | Hampshire | D6/323 |
| 6,199,811 | B1 | * | 3/2001 | Fargo | 248/304 |
| D442,850 | S | * | 5/2001 | Gary et al. | D8/367 |
| D459,028 | S | | 6/2002 | Hsu | |
| D465,340 | S | * | 11/2002 | Hoernig | D6/323 |
| 6,637,707 | B1 | * | 10/2003 | Gates et al. | 248/224.7 |
| D483,593 | S | * | 12/2003 | Knapp | D6/572 |
| 2003/0189147 | A1 | * | 10/2003 | Immerman | 248/304 |

* cited by examiner

*Primary Examiner*—Amy J. Sterling

(57) ABSTRACT

A hair collection device for collecting hair from the hand of user to remove hair from the head left on the hand of the user during a shower. The hair collection device includes a collection member being designed for being selectively coupled to a wall of the shower. The collection member is designed for receiving the hair from the hand of the user to allow the user to collect the hair at a later time to be thrown out when the hand of the user is wiped across the collection member. At least one mounting member is coupled to the collection member. The mounting member is designed for selectively engaging the wall of the shower to secure the collection member to the wall.

1 Claim, 3 Drawing Sheets

HAIR COLLECTION DEVICE

BACKGROUND OF THE INVENTION

1. Field of the Invention

The present invention relates to hair removal systems and more particularly pertains to a new hair collection device for collecting hair from the hand of user to prevent the hair from being rinsed down the drain.

2. Description of the Prior Art

The use of hair removal systems is known in the prior art. U.S. Pat. No. 5,269,073 describes a device for vacuuming hair as it clipped from the head of a person getting their hair cut. Another type of hair removal system is U.S. Pat. No. Des. 205,452 showing a combined electric hair clippers, vacuum cleaner and stand. U.S. Pat. No. Des. 459,028 shows a electrical hair ball remover.

While these devices fulfill their respective, particular objectives and requirements, the need remains for a device that has certain improved features to remove hair from the head left on the hand of the user during a shower.

SUMMARY OF THE INVENTION

The present invention meets the needs presented above by providing a receiving member coupled to the front surface of the collection member engage the hair and remove the hair when the hand is wiped across the front surface of the collection member.

Still yet another object of the present invention is to provide a new hair collection device that provides extension portions to extend between the fingers of the hand to engage the hair and remove the hair from around the fingers of the hand.

Even still another object of the present invention is to provide a new hair collection device that applies pressure to the fingers and hand to massage the hand and provide a pleasant feeling for the user.

To this end, the present invention generally comprises a collection member being designed for being selectively coupled to a wall of the shower. The collection member is designed for receiving the hair from the hand of the user to allow the user to collect the hair at a later time to be thrown out when the hand of the user is wiped across the collection member. At least one mounting member is coupled to the collection member. The mounting member is designed for selectively engaging the wall of the shower to secure the collection member to the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
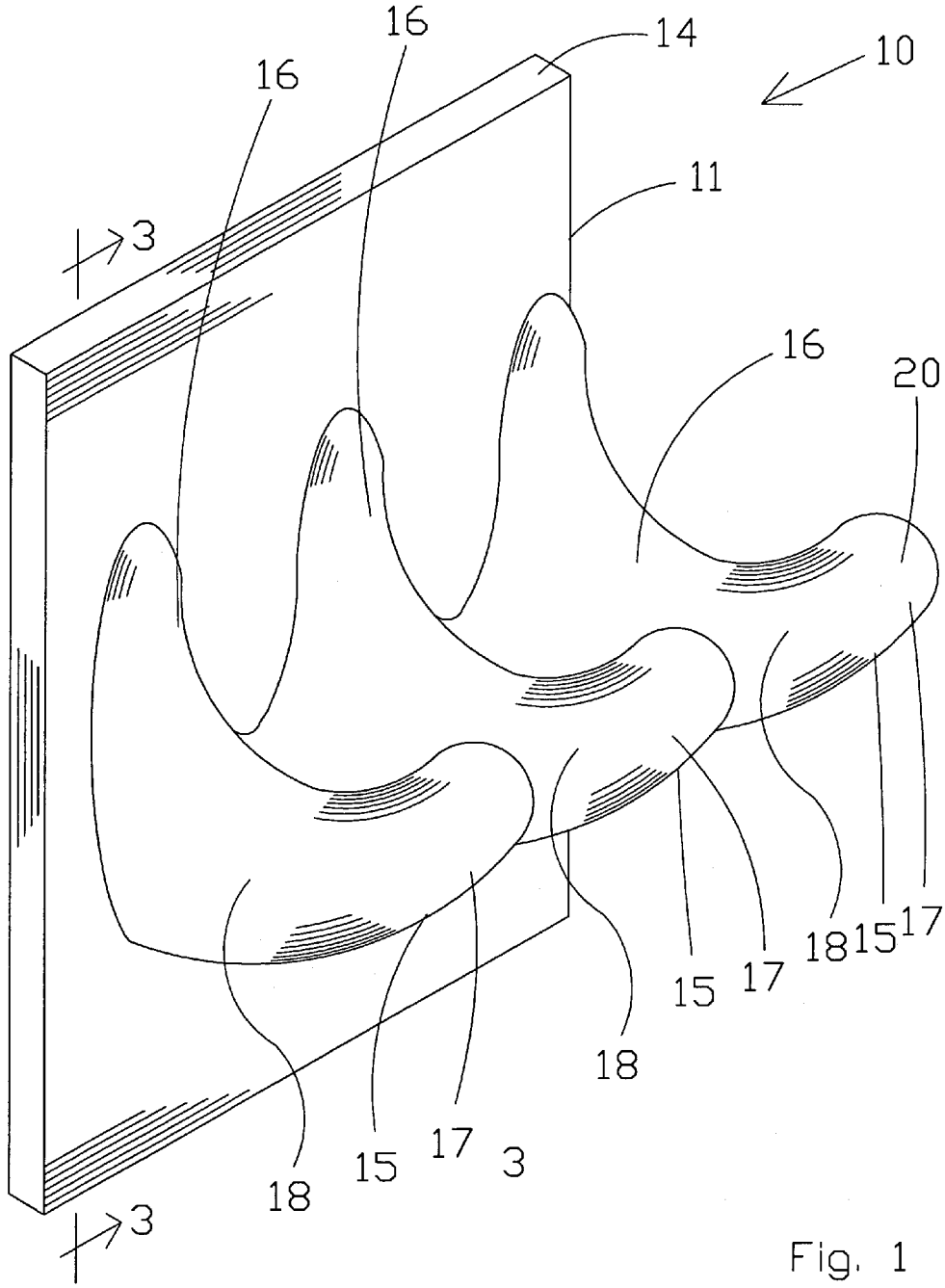
FIG. 1 is a perspective view of a new hair collection device according to the present invention.
Figure 2:
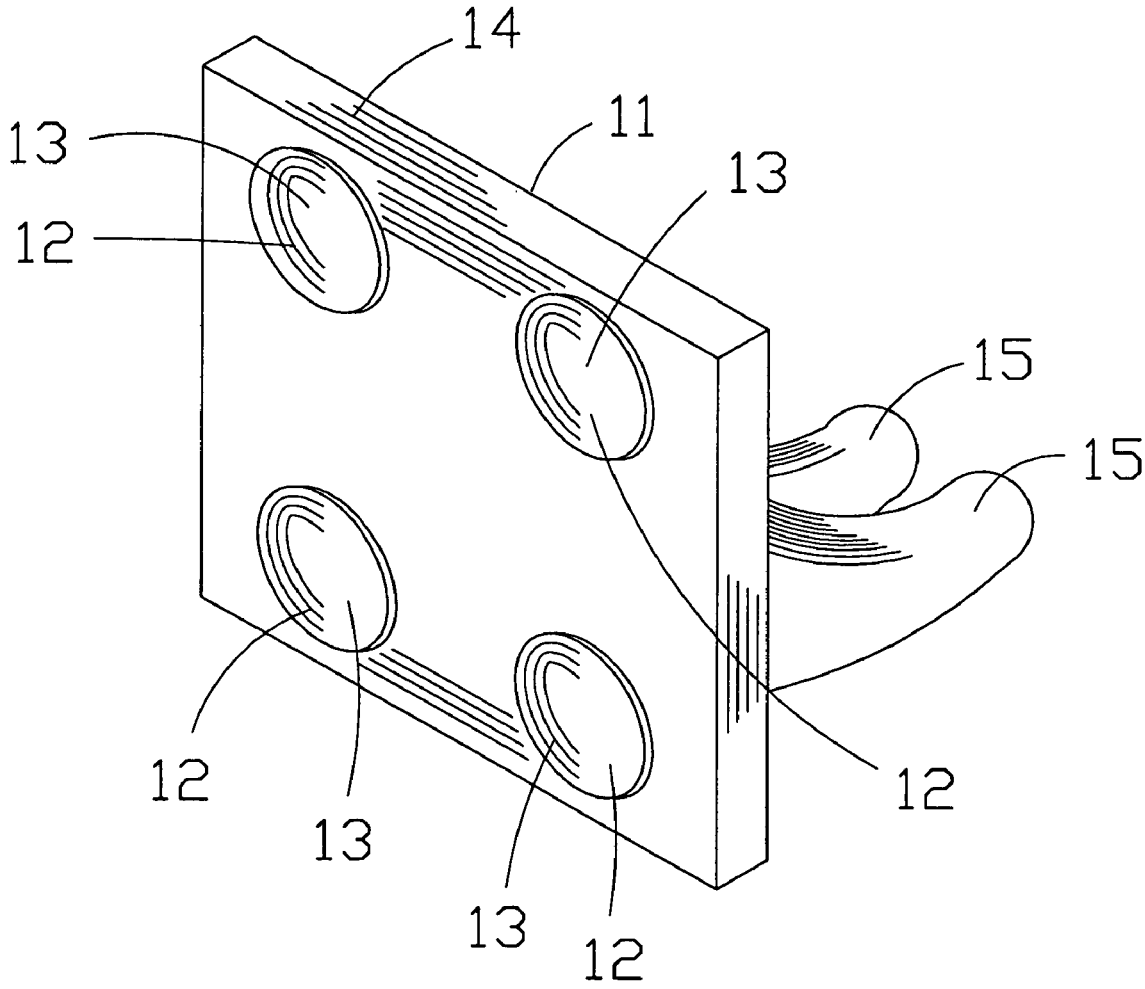
FIG. 2 is a perspective view of the present invention.
Figure 3:
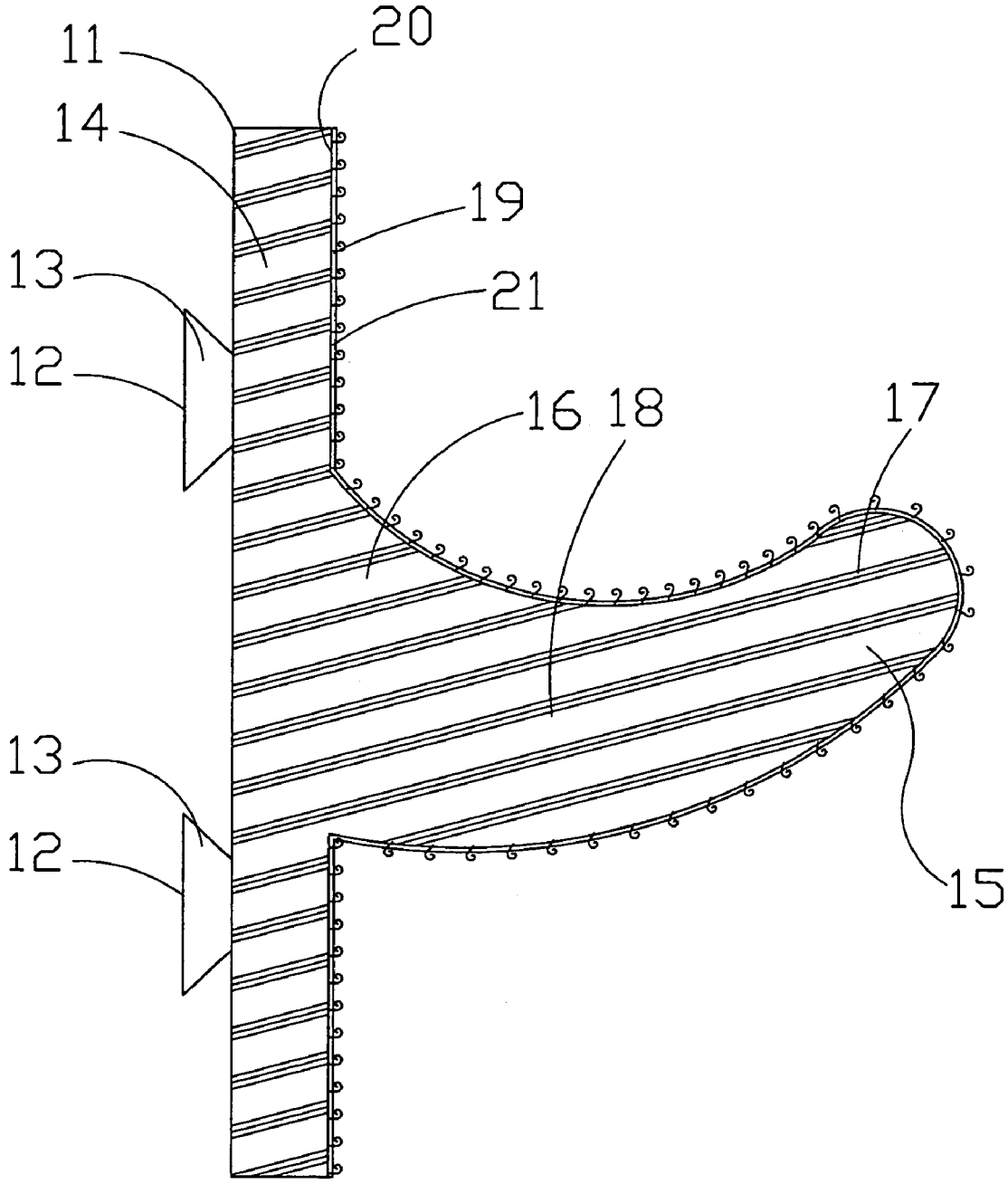
FIG. 3 is a cross-sectional view of the present invention taken along line 3—3 of FIG. 1.

With reference now to the drawings, and in particular to FIGS. 1 through 3 thereof, a new hair collection device embodying the principles and concepts of the present invention and generally designated by the reference numeral 10 will be described.

As best illustrated in FIGS. 1 through 3, the hair collection device 10 generally comprises a collection member 11 being designed for being selectively coupled to a wall of the shower. The collection member 11 is designed for receiving the hair from the hand of the user to allow the user to collect the hair at a later time to be thrown out when the hand of the user is wiped across the collection member 11.

At least one mounting member 12 is coupled to the collection member 11. The mounting member 12 is designed for selectively engaging the wall of the shower to secure the collection member 11 to the wall. The mounting member 12 comprises a suction cup member 13. The suction cup member 13 is coupled to the collection member 11 whereby the collection member 11 is used to force the suction cup member 13 to engage the suction member to the wall. The suction cup member 13 is designed for creating a vacuum against the wall to secure the suction cup member 13 and the collection member 11 to the wall. The suction cup member 13 is about 1 inch in diameter.

The collection member 11 comprises a plate portion 14 and at least one extension portion 15. Three of the extension portions 15 provides an optimum in that each of the extension portions 15 can be positioned between adjacent fingers of the hand. The mounting member 12 is coupled to the plate portion 14. The extension portion 15 extends outwardly from the plate portion 14 whereby the extension portion 15 is designed for being positioned opposite the wall when the collection member 11 is coupled to the wall. The extension portion 15 is designed for being positioned between fingers of the hand of the user whereby the extension portion 15 receives the hair from the hand of the user when the extension portion 15 passes between the fingers of the user. The plate portion 14 comprises a width of about 3½ inches and a length of about 4 inches. The extension portion 15 has length of about 2¼ inches and are spaced about ¾ of inch apart when multiple extension portions 15 are used.

The extension portion 15 comprises a base portion 16 and an end portion 17. The base portion 16 of the extension portion 15 is coupled to the plate portion 14. The end portion 17 extends outwardly from the extension portion 15 whereby the end portion 17 is positioned opposite the plate portion 14. The end portion 17 of the extension portion 15 is designed for being inserted between the fingers of the user. The end portion 17 of the extension portion 15 comprises a substantially hemispherical shape whereby the hemispherical shape is designed for inhibiting damage to the hand of the user when the extension portion 15 is positioned between the fingers of the hand of the user.

The extension portion 15 comprises a medial portion 18. The medial portion 18 is positioned between the base portion 16 and the end portion 17 whereby the medial portion 18 positions the end portion 17 in a spaced relationship from the plate portion 14. The medial portion 18 is designed for being positioned along side of the fingers of the hand to receive hair from the hand when the end portion 17 is positioned between the fingers of the hand. The medial portion 18 of the extension portion 15 comprises an arcuate shape. The arcuate shape of the medial portion 18 is designed rubbing against the fingers and the hand of the user to receive hair from the fingers of the user. The medial portion 18 of the extension portion 15 comprises a substantially circular cross-section taken along a plane perpendicular to a longitudinal axis of the extension portion 15. The circular cross-section is designed for inhibiting injury to the hand of the user when the medial portion 18 is positioned between the fingers of the hand. The circular cross-section of the medial portion 18 is about ¾ of an inch in diameter.

A receiving member 19 is coupled to a front surface 20 of the collection member 11. The receiving member 19 is designed for engaging hair on the hand of the user whereby the receiving member 19 facilitates removal of the hair from the hand of the user when the hand of the user is wiped across the collection member 11.

The receiving member 19 comprises a first portion of hook and loop fastener 21, such as a hook portion of hook and loop fastener. The hook portion of hook and loop fastener is designed for engaging the hair on the hand of the user whereby the hook portion of hook and loop fastener facilitates removal of the hair from the hand of the user.

In use, the user takes the collection member 11 and pushes it against the wall to compress the suction cup member 13 against the wall to allow the suction cup member 13 to create a vacuum against the wall and secure the collection member 11 to the wall. The user then wipes their hand across the front surface 20 of the collection member 11 so that the extension portion 15 slides between the fingers of the hand. The receiving member 19 on the front surface 20 of the collection member 11 then engages the hair and removes the hair from the hand of the user. The user has completed their shower the hair collected on the receiving member 19 is pulled off of the collection member 11 and thrown away to prevent the hair from being rinsed down the drain and possibly clogging the drain.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair collection device for receiving hair from a hand of a user when the user is taking a shower, the hair collection device comprising:

a collection member being adapted for being selectively coupled to a wall of the shower, said collection member being adapted for receiving the hair from the hand of the user to allow the user to collect the hair at a later time to be thrown out when the hand of the user is wiped across said collection member;

a plurality of mounting members being coupled to the collection member, said plurality of mounting members being adapted for selectively engaging the wall of the shower to secure said collection member to the wall;

a receiving member being coupled to a front surface of said collection member, said receiving member being adapted for engaging hair on the hand of the user such that said receiving member facilitates removal of the hair from the hand of the user when the hand of the user is wiped across the collection member;

said receiving member comprising a first portion of hook and loop fastener, said first portion of hook and loop fastener being adapted for engaging the hair on the hand of the user such that said first portion of hook and loop fastener facilitates removal of the hair from the hand of the user;

said collection member comprising a plate portion and a plurality of extension portions, said mounting member being coupled to said plate portion, said plurality of extension portions extending outwardly from said plate portion such that said plurality of extension portions are adapted for being positioned opposite the wall when said collection member is coupled to the wall, said plurality of extension portions being adapted for being positioned between fingers of the hand of the user such that said extension portions receive the hair from the hand of the user when said extension portions pass between the fingers of the user;

said plurality of extension portions each comprising a base portion and an end portion, said base portion of each said extension portion being coupled to said plate portion, said end portion extending outwardly from said extension portion such that said end portion is positioned opposite said plate portion, said end portion of said extension portion being adapted for being inserted between the fingers of the user;

said plurality of extension portions each comprising a medial portion, said medial portion being positioned between said base portion and said end portion such that said medial portion positions said end portion in a spaced relationship from said plate portion, said medial portion being adapted for being positioned along side of the fingers of the hand to receive hair from the hand when said end portion is positioned between the fingers of the hand; and said medial portion of each said extension portion comprising an arcuate shape, said arcuate shape of said medial portion being adapted for rubbing against the fingers and the hand of the user to receive hair from the fingers of the user;

said collection member having a front surface on which each of said plurality of extension portions is mounted, and each said element of said extension portions has an exterior surface, said receiving member being substantially coextensive with the front surface of said collection member, and said receiving member is substantially coextensive with the exterior surface of said extension portions;

said mounting member comprising a suction cup member, said suction cup member being coupled to said collection member such that said collection member is used to force said suction cup member to engage the wall, said suction cup member being adapted for creating a vacuum against the wall to secure said suction cup member and said collection member to the wall;

said first portion of hook and loop fastener comprising a hook portion of hook and loop fastener for hooking onto the hair to facilitate removal of the hair from the hand of the user;

said medial portion of each said extension portion comprising a substantially circular cross-section taken along a plane perpendicular to a longitudinal axis of said extension portion, said circular cross-section being adapted for inhibiting injury to the hand of the user when said medial portion is positioned between the fingers of the hand.

* * * * *